US006997373B2

(12) United States Patent
Flores

(10) Patent No.: US 6,997,373 B2
(45) Date of Patent: Feb. 14, 2006

(54) MAILBOX WITH SLIDING TRAY

(76) Inventor: Cesar Flores, 222 Forest Rd., Wallkill, NY (US) 12589

( * ) Notice: Subject to any disclaimer, the term of this patent is extended or adjusted under 35 U.S.C. 154(b) by 2 days.

(21) Appl. No.: 10/847,378

(22) Filed: May 18, 2004

(65) Prior Publication Data

US 2005/0258227 A1 Nov. 24, 2005

(51) Int. Cl.
*B65D 91/00* (2006.01)

(52) U.S. Cl. ..... 232/29; 232/17

(58) Field of Classification Search ..... 232/17, 232/33, 29

See application file for complete search history.

(56) References Cited

U.S. PATENT DOCUMENTS

| | | | | |
|---|---|---|---|---|
| 838,194 | A | 12/1906 | Larsh | |
| 908,543 | A | 1/1909 | Brown | |
| 1,220,251 | A | 3/1917 | Martin | |
| 1,471,899 | A | 10/1923 | Koenig | |
| 2,868,444 | A | 1/1959 | Whitter | |
| 4,160,520 | A * | 7/1979 | Cluthe | 232/17 |
| 4,362,267 | A | 12/1982 | Donaldson | |
| 4,600,143 | A | 7/1986 | Harlow, Jr. et al. | |
| 4,714,192 | A | 12/1987 | Harlow, Jr. et al. | |
| 4,753,385 | A | 6/1988 | Phipps et al. | |
| 4,896,827 | A | 1/1990 | Economou | |
| 4,932,587 | A * | 6/1990 | Robbins | 232/17 |
| 5,009,366 | A | 4/1991 | van Druff, Jr. et al. | |
| 5,060,900 | A | 10/1991 | Kokoruda et al. | |
| 5,271,555 | A | 12/1993 | Mayer | |
| 5,765,749 | A | 6/1998 | Harper | |
| 6,698,651 | B1 | 3/2004 | Green | |
| 2002/0109005 | A1 | 8/2002 | Billings | |
| 2004/0211827 | A1 * | 10/2004 | Gunvaldson | 232/19 |

FOREIGN PATENT DOCUMENTS

| | | |
|---|---|---|
| EP | 0 583 182 | 2/1994 |
| FR | 2 824 507 | 11/2002 |

* cited by examiner

*Primary Examiner*—William L. Miller
(74) *Attorney, Agent, or Firm*—Richard C. Litman

(57) ABSTRACT

The mailbox with sliding tray is a mailbox housing with a tray guided on a pair of tracks to dispose the tray completely outside the housing. Each track has a plurality of slides. One pair of slides is attached to the mailbox housing and another pair is attached to the tray. The tracks are preferably telescopic, ball bearing tracks that glide along each other to dispose the tray completely outside the housing. A door is attached to a front edge of the tray by a hinge. The door serves as a handle to either pull down the door and view the inside of the mailbox or pull down the door and slide the tray forward, away from the mailbox housing, to view the entire length of the tray.

15 Claims, 4 Drawing Sheets

MAILBOX WITH SLIDING TRAY

BACKGROUND OF THE INVENTION

1. Field of the Invention

The present invention relates to mailboxes, more particularly to a mailbox having a sliding bottom tray for depositing and retrieving mail.

2. Description of the Related Art

Traditional mailboxes provide a housing and a stationary floor for depositing mail. Individuals must reach into the mailbox to retrieve the mail. Some individuals fear sticking their hand into the mailbox out of fear of what may lie inside and do not want to blindly reach into the mailbox to retrieve mail. In any case, mail sometimes is pushed into the rear of the mailbox and may be unintentionally left behind. Another problem with traditional mailboxes resides in the fact that users must get out of their vehicle and walk up to the mailbox to retrieve their mail.

Some mailboxes have been developed having a sliding tray to alleviate some of the aforementioned problems. These mailboxes, however, still leave room for improvement. For example, some sliding mailbox trays only expose a portion of the tray, leaving the rear portion of the mailbox hidden. Other sliding tray mailboxes are rigidly attached to the door, so that when the door is opened the tray automatically slides out, leaving the user without the option of merely opening the door to peer into the mailbox, since it is impossible to open the door without sliding out the tray. Still others use removable trays that do not have guides to direct the tray out of the mailbox, and which often have stops to prevent the tray from falling out of the mailbox. Therefore, a mailbox is desired that has a tray guided by tracks to extend out past the housing of the mailbox, thereby allowing the user see the entire tray and its contents.

U.S. Pat. No. 1,220,251, issued to Martin on Mar. 27, 1917, discloses a letter holder. The holder is attached to the mailbox by a track and has a spring clip on one end to hold a single letter. U.S. Pat. No. 838,194, issued to Larsh on Dec. 11, 1906, discloses a mailbox having a sliding drawer that is attached to the door of the mailbox by bars. When the door opens the drawer is drawn forward and partially out of the mailbox. The '194 invention does not show the entire drawer fully extended outside the mailbox.

U.S. Pat. No. 908,543, issued to Brown on Jan. 5, 1909, discloses a mailbox having a sliding tray. The tray is attached to the door and moves with the door. Thus, when the door opens, the tray simultaneously swings out and tilts downward with the door. The tray utilizes stops to prevent the tray from extending completely outside the mailbox.

U.S. Pat. No. 1,471,899, issued to Koenig on Oct. 23, 1923, discloses a mailbox having a sliding drawer placed in the bottom of the mailbox. The drawer is connected to the inner sides of the mailbox and is drawn out when the mailbox door is swung open. Thus the '899 mailbox only allows the drawer to partially extend out of the mailbox housing. U.S. Patent Publication No. 2002/0109005, published on Aug. 15, 2002, discloses a tray for receiving and containing mail that may be used within a standard United States Post Office mailbox.

U.S. Pat. No. 2,868,444, issued to Whittier on Jan. 13, 1959, discloses a mailbox accessory which is a unitary receptacle that can be used in standard existing mailboxes without requiring fasteners or having to alter existing mailboxes. The receptacle has stop means to prevent it from fully extending out of the mailbox. U.S. Pat. No. 4,362,267, issued to Donaldson on Dec. 7, 1982, discloses a mailbox tray that can be partially pulled out to access its contents.

U.S. Pat. No. 4,600,143, issued on Jul. 15, 1986, and U.S. Pat. No. 4,714,192, issued on Dec. 22, 1987, both to Harlow, Jr. et al., disclose a slidable tray insert for mailboxes. The tray has finger elements at the rear end of the tray to abut the edges of the opening of the mailbox and prevent the tray from falling out of the box. The '143 patent does not have tracks guiding the tray out of the box, nor does the tray completely extend outside the mailbox.

U.S. Pat. No. 4,753,385, issued to Phipps et al. on Jun. 28, 1988, discloses an extendable mailbox tray. The tray is made from folded sheet material that, when assembled, can slidingly cooperate with any mailbox. The '385 patent does not have tracks guiding the tray out of the box.

Mailboxes having a sliding mail tray or an insert are also disclosed in U.S. Pat. No. 4,896,827, issued to Economou on Jan. 30, 1990; U.S. Pat. No. 5,009,366, issued to van Druff, Jr. et al. on Apr. 23, 1991; U.S. Pat. No. 5,060,900, issued to Kokoruda et al. on Oct. 29, 1991; U.S. Pat. No. 5,765,749, issued to Harper on Jun. 16, 1998; U.S. Pat. No. 6,698,651, issued to Green on Mar. 2, 2004 (mailbox tray that extends partially outside the mailbox); U.S. Pat. No. 5,271,555, issued to Mayer on Dec. 21, 1993; European Patent Number 583,182, published on Feb. 16, 1994; and French Patent Number 2,824,507, published on Nov. 15, 2002 (two adjacent trays).

None of the above inventions and patents, taken either singly or in combination, is seen to describe the instant invention as claimed. Thus a mailbox with a sliding tray solving the aforementioned problems is desired.

SUMMARY OF THE INVENTION

The mailbox with sliding tray of the present invention includes a mailbox housing with a sliding tray guided on a pair of tracks, similar to a file drawer mechanism, to dispose the tray completely outside the housing. Each track comprises a plurality of slides. One pair of slides is rigidly attached to the mailbox housing and another pair of slides is rigidly attached to the tray. The tracks are preferably telescopic, ball bearing tracks that glide along each other to dispose the tray completely outside the housing. A door is pivotally attached to a front edge of the tray by a hinge. The door serves as a handle to either pull down the door and view the inside of the mailbox, or to pull down the door and slide the tray forward, away from the mailbox housing, to view the entire length of the tray.

These and other features of the present invention will become apparent upon consideration of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
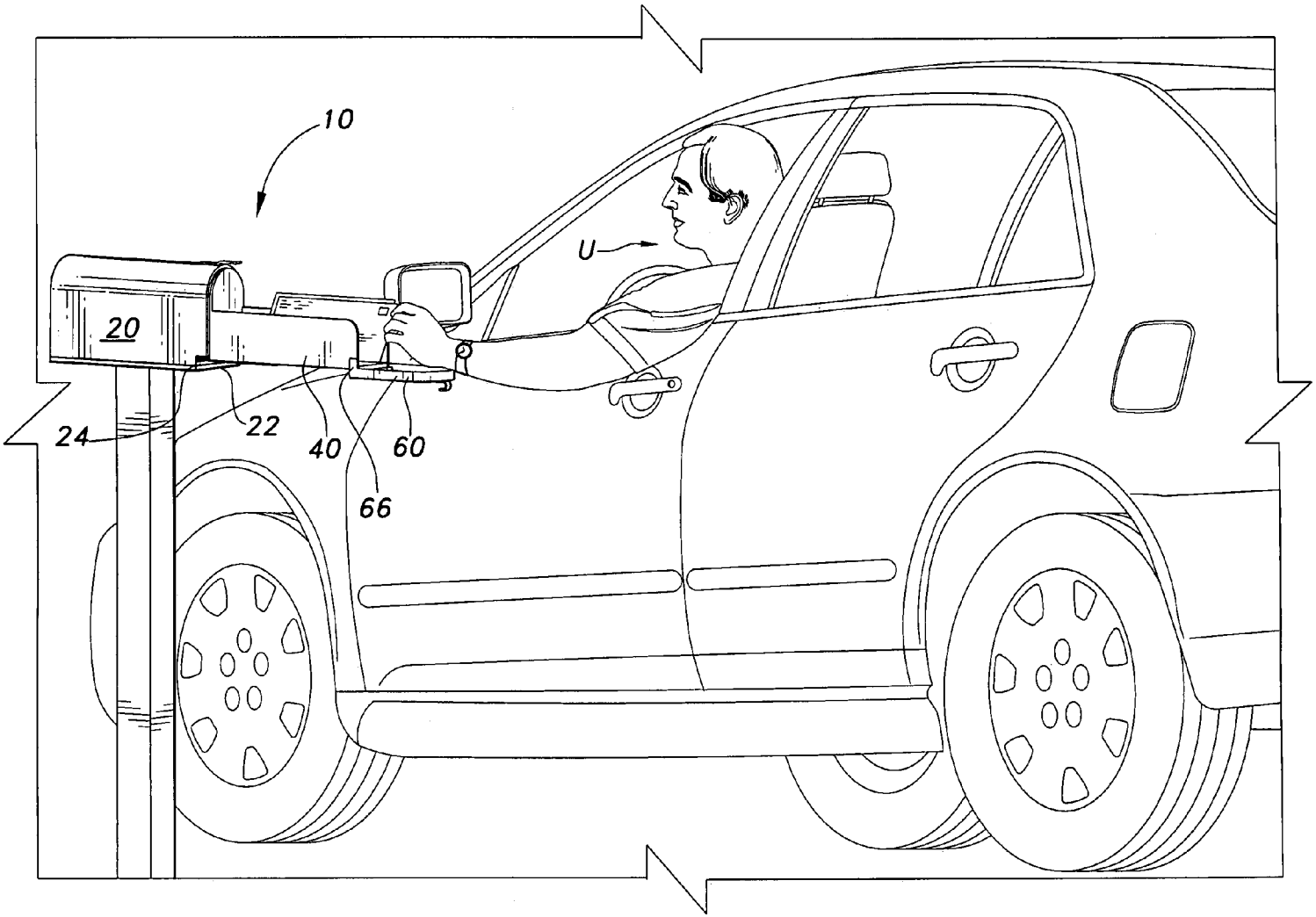
FIG. 1 is an environmental, perspective view of a mailbox with a sliding tray according to the present invention.
Figure 4:
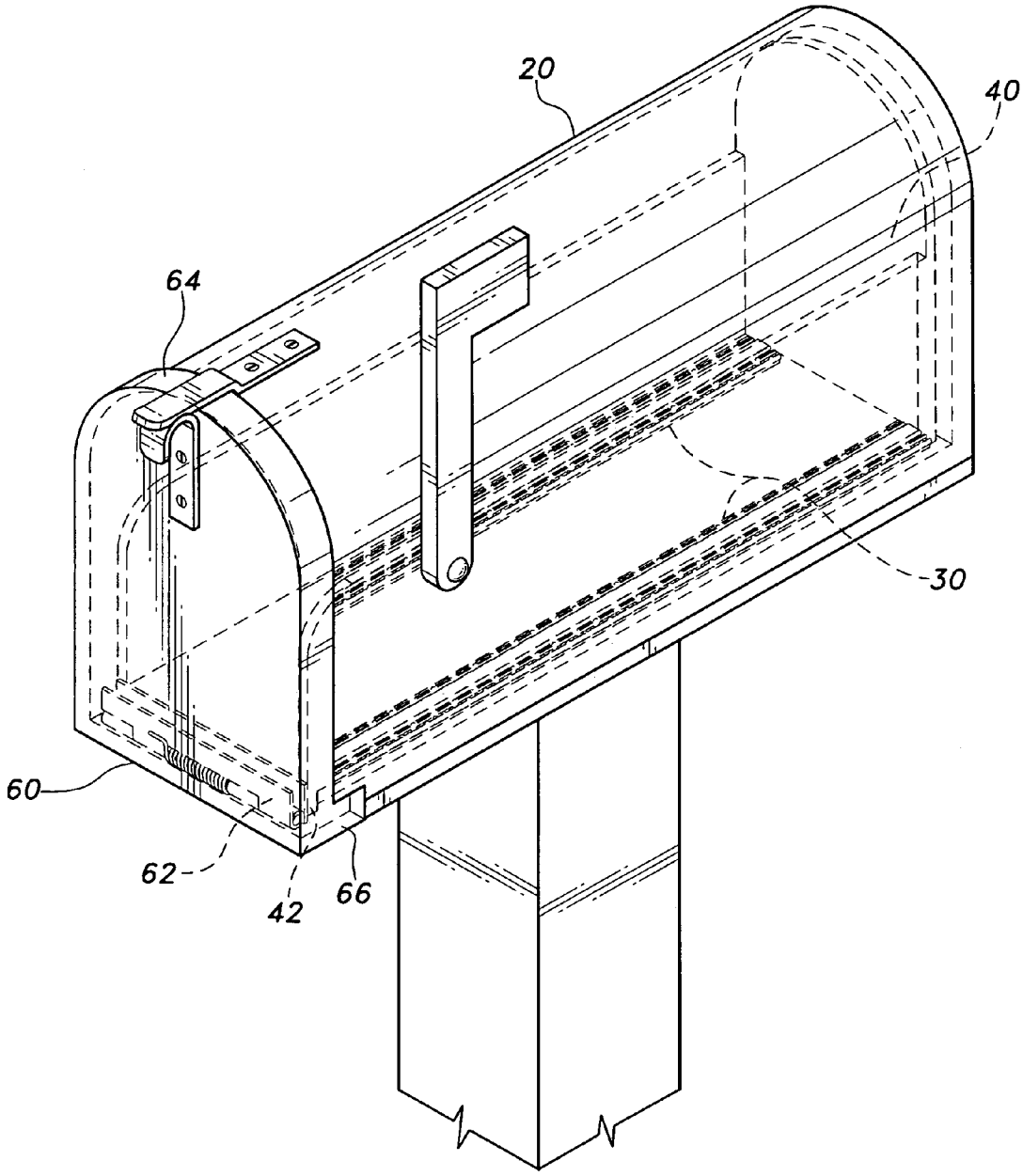
FIG. 4 shows the mailbox of the present invention with the door in a closed position.

The present invention is a mailbox with sliding tray, designated as 10 in the drawings. The mailbox 10 shown in the figures is a post-mounted, rural type of mailbox having a housing 20, which is defined by a U-shaped body, a back wall and a floor 22. As shown in FIG. 1, the mailbox 10 comprises the housing 20, a tray 40 slidingly mounted within the housing 20 and a door 60 attached to the tray 40. The tray 40 has a floor having an underside, a topside and a front edge as well as short sidewalls and a back wall. The tray 40 may have a lip 42 that extends down about half an inch to one-inch from its front edge, as seen in FIG. 4. In use, a user U uses the door 60 as a handle and can pull the tray 40 completely outside the housing 20 to retrieve or deposit mail on the top side of the tray 40. By pulling the tray 40 outside the housing 20, the user U is able to retrieve the mail while seated in a vehicle a convenient distance away from the housing 20.

Figure 2:
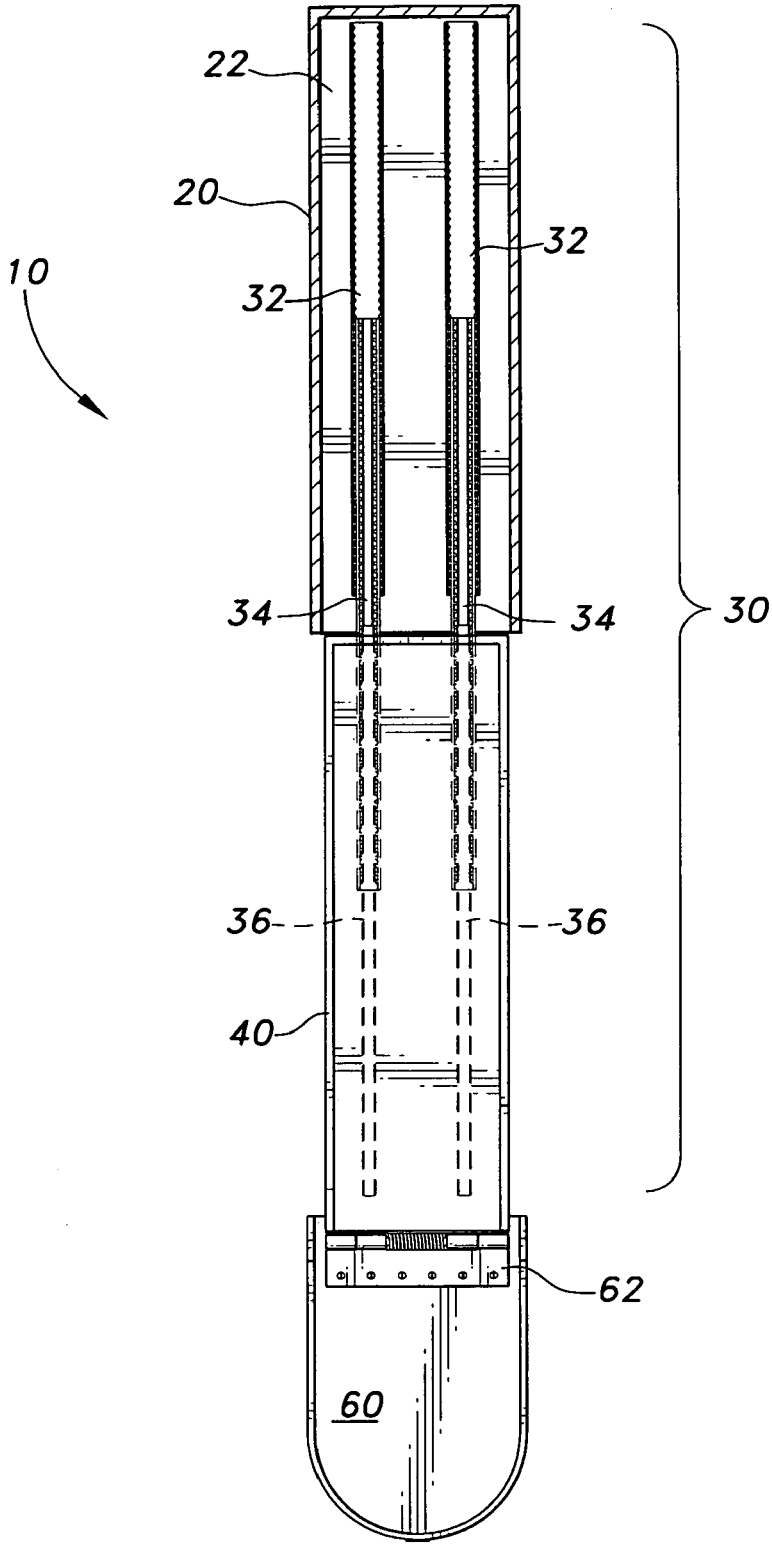
FIG. 2 is a plan view of the mailbox with sliding tray of the present invention with the mailbox in section to show the sliding track mechanism in an extended position.

Referring now to FIG. 2, the tray 40 easily moves in and out of the housing 20 via a track 30 disposed between the housing 20 and the tray 40. In particular, mailbox 10 uses two tracks 30. The tracks 30 are preferably disposed on the floor 22 of the housing 20 and the underside of the tray 40. Alternatively, the tracks 30 may be disposed on the sides of the U-shaped body of the housing 20 and the exterior sidewalls of the tray 40.

The tracks 30 comprise three telescoping slides 32, 34, 36. Slide 36 is fixed to the tray 40, slide 32 is fixed to the housing 20 and slide 34 is an intermediary slide between slides 32 and 36. The tracks 30 preferably use ball bearings but could use a wheel system, a sliding system or any other system that permits the tray 40 to slide. When the tray 40 is pulled out of the housing 20, the slides 32, 34, 36 glide along the ball bearings and telescope out of the housing 20. When the tray 40 is retracted within the housing 20, the slides 32, 34, 36 nest within each other and lie flat between the housing 20 and the tray 40. The mailbox 10 is shown possessing a pair of tracks 30, however one track or more than two tracks can be used with the mailbox 10 and still function within the spirit of the invention. Likewise, instead of the tracks 30 each possessing three slides, two slides or more than three slides may be used within one track. If more than three slides are used in one track, then the tray 40 will extend out of the housing 20 at a greater distance than if only three slides are used.

Figure 3:
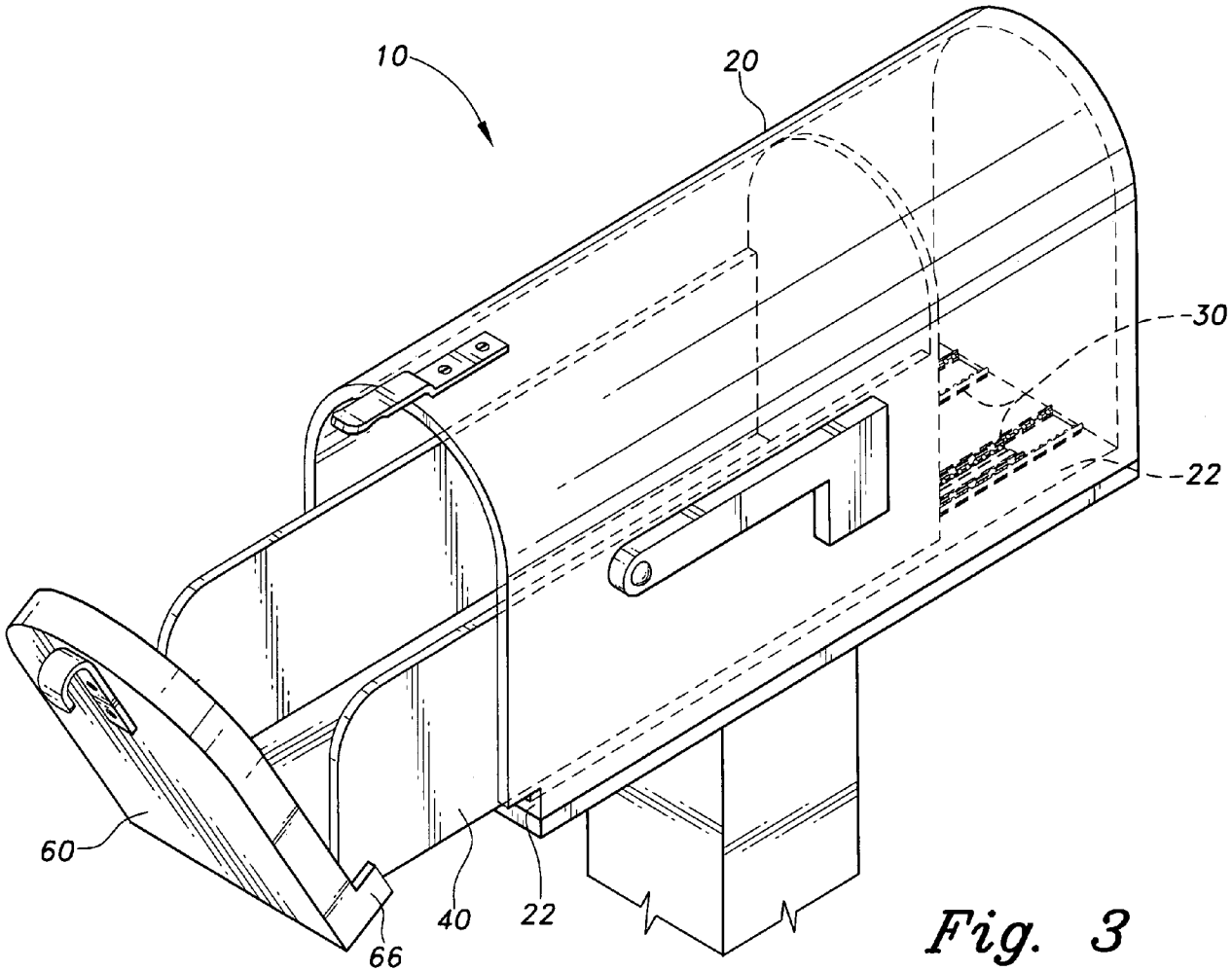
FIG. 3 is a side perspective view of the mailbox of the present invention shown with the door ajar and the tray partially extended.

Referring now to FIGS. 2, 3 and 4, mailbox 10 is shown with the door 60 being attached to the tray 40. Preferably the door 60 is attached to the tray 40 by a hinge 62, such as a piano hinge, or by a resilient, self-closing hinge, such as a spring hinge. The hinge 62 has two plates. One plate is attached to the inside of the door 60 about one inch from the bottom of the door 60. The second plate is attached to the lip 42 at the front edge of the tray 40. In the absence of lip 42, the second plate of the hinge 62 may be attached to the underside of the tray 40. The hinge 62 will rest in a zero degree position when the second plate of the hinge rests on the lip 42, and will rests in a 90° position when the second plate of the hinge rests on the underside of the tray 40. Optionally, the door 60 may be directly attached to the slides 36 of the tracks 30, particularly the section disposed on the underside of the tray 40, rather than being attached directly to the tray 40.

By disposing the hinge 62 between the door 60 and the tray 40, the door 60 can be used as a handle to manipulate the mailbox 10. Since the user U must physically pull the door 60 forward to expose the tray 40, the mere opening and the closing of the door 60, by itself, will not cause the tray 40 to be extended outside the housing 20. Therefore, in use, the user U has the option of pulling the door 60 down to peer into the housing 20 or pulling the door 60 both down and forward to extend the tray 40 completely outside the housing 20.

Referring back to FIG. 1, the mailbox 10 uses the resilient, self-closing, spring hinge 62 between the tray 40 and the door 60. Here, the user U is shown reaching for the mail by simultaneously applying some pressure on the door 60 to keep it from closing. When the user U releases the door 60, the door 60 automatically folds up, returning to its upright position. Momentum, either by the user pushing the door 60 or from the force of the door 60 returning to its upright position, causes the door 60 and the track 40 to automatically glide back toward the housing 20. If, however, a piano hinge or other non-resilient hinge is used to pivotally attach the door 60, then the door 60 would lie straight down from the tray 40 and the user U would be required to push the door 60 back to the housing 20.

The door 60 may have a flange 64 that extends out and rests around the U-shaped body of the housing 20 when the door 60 is closed, as shown in FIG. 4. As shown in FIGS. 1, 3 and 4, front corners of the housing 20 have cut out openings 24 and the bottom portion of the door 60 has earpieces 66. The cut out openings 24 permit the door 60 to open without obstruction, as seen in FIG. 3. The earpieces 66 cover up the cut out openings 24 when the mailbox 10 is closed, as seen in FIG. 4. If desired, the door 60 may be recessed and rest within the housing 20, in which case no lip 42 is necessary and the hinge 62 is attached directly to the underside of the tray 40.

The housing 20 may be made of any material used in the art, such as aluminum, galvanized steel or plastic. The tracks 30 and the tray 40 may be made of plastic, metal or any other sturdy material. Although illustrated with respect to a rural mailbox, the sliding tray may be used in mailboxes other than the rural type, and may use alternative types of guides or tracks which permit the tray 40 to extend completely outside the housing 20.

It is to be understood that the present invention is not limited to the embodiment described above, but encompasses any and all embodiments within the scope of the following claims.

I claim:

1. A mailbox with sliding tray, comprising:

a housing having an elongate, U-shaped body, a back wall and a floor defining a mailbox having a front opening;

a tray having a floor with a top side, an underside and a front edge, short sidewalls and a back wall, the tray being disposed within the housing;

a track having a plurality of slides, including a first slide attached to the housing and a second slide attached to the tray, the slides being telescoping, whereby the tray is extensible completely outside the housing; and a door pivotally attached to the tray.

2. The mailbox according to claim 1, wherein said track consists of a single track.

3. The mailbox according to claim 1, wherein said track comprises a plurality of tracks.

4. The mailbox according to claim 1, wherein said track consists of two slides within said track.

5. The mailbox according to claim 1, wherein said track comprises at least three slides within said track.

6. The mailbox according to claim 1, wherein the slides of said track are nested within each other so that said track lies flat between the housing and the tray.

7. The mailbox of claim 1, wherein said slides are ball bearing slides.

8. The mailbox of claim 1, wherein said slides are wheel-mounted slides.

9. The mailbox of claim 1, wherein said track is mounted on the floor of the housing and the underside of the tray.

10. The mailbox according to claim 1, further comprising a hinge pivotally attaching said door to said tray.

11. The mailbox according to claim 1, wherein said hinge is attached to the underside of said tray at the front edge of said tray.

12. The mailbox according to claim 1, further comprising a lip attached to the front edge of the floor of said tray.

13. The mailbox according to claim 12, further comprising a hinge attached to the lip of said tray.

14. The mailbox according to claim 1, further comprising a resilient hinge pivotally attaching said door to said tray.

15. The mailbox according to claim 1, further comprising a piano hinge pivotally attaching said door to said tray.

* * * * *